US005303948A

United States Patent [19]

Le Masson et al.

[11] Patent Number: 5,303,948

[45] Date of Patent: Apr. 19, 1994

[54] SKI FOR WINTER SPORTS COMPRISING AN ASSEMBLY PLATFORM FOR THE BINDINGS

[75] Inventors: Jacques Le Masson, Cran-Gevrier; Jean-Pierre Clement, Annecy, both of France

[73] Assignee: Salomon S.A., Annecy Cedex, France

[21] Appl. No.: 824,164

[22] Filed: Jan. 22, 1992

[30] Foreign Application Priority Data

Feb. 8, 1991 [FR] France ..... 91 01703

[51] Int. Cl.[5] ..... A63C 5/00

[52] U.S. Cl. ..... 280/607; 280/602

[58] Field of Search ..... 280/607, 601, 602, 610

[56] References Cited

U.S. PATENT DOCUMENTS

| | | | |
|---|---|---|---|
| 4,035,442 | 7/1991 | Arnsteiner | 280/602 |
| 4,405,149 | 9/1983 | Piegay | 280/602 |
| 4,438,946 | 3/1984 | Piegay | 280/602 |
| 4,556,237 | 12/1985 | Meatto et al. | 280/610 |
| 4,848,786 | 7/1989 | Mankau | 280/602 |
| 4,953,884 | 9/1990 | Diard et al. | 280/609 |
| 4,961,592 | 10/1990 | Diard et al. | 280/609 |
| 5,000,475 | 3/1991 | Gagneux et al. | 280/602 |
| 5,002,300 | 3/1991 | Pascal et al. | 280/602 |
| 5,002,301 | 3/1991 | Pascal et al. | 280/602 |
| 5,016,901 | 5/1991 | Mayr | 280/607 |
| 5,026,086 | 6/1991 | Guers et al. | 280/607 |
| 5,033,765 | 7/1991 | Gagneux et al. | 280/602 |
| 5,064,214 | 11/1991 | Diard et al. | 280/607 |
| 5,092,618 | 3/1992 | Mayr | 280/610 |

FOREIGN PATENT DOCUMENTS

| | | | |
|---|---|---|---|
| 0062723 | 10/1982 | European Pat. Off. | A63C 5/12 |
| 344146 | 11/1989 | European Pat. Off. | 280/610 |
| 1428966 | 1/1969 | Fed. Rep. of Germany | 280/602 |
| 3711219 | 12/1987 | Fed. Rep. of Germany | 280/602 |
| 3934891 | 5/1990 | Fed. Rep. of Germany | 280/607 |
| 2611518 | 9/1988 | France | A63C 5/04 |
| 2639837 | 6/1990 | France | A63C 5/075 |

*Primary Examiner*—Eric Culbreth

*Attorney, Agent, or Firm*—Sandler Greenblum & Bernstein

[57] ABSTRACT

Ski, especially an alpine ski, having the shape of an elongated beam including a core, a lower reinforcement and an upper reinforcement and including, in the assembly zone of the bindings, at least one shock absorption element, wherein the shock absorption element is arranged on the first upper reinforcement and beneath a second upper central reinforcement.

27 Claims, 5 Drawing Sheets

SKI FOR WINTER SPORTS COMPRISING AN ASSEMBLY PLATFORM FOR THE BINDINGS

BACKGROUND OF THE INVENTION

1. Field of the Invention

The present invention relates to a ski, such as an alpine ski, a cross-country ski, a monoski or a snowboard. More particularly, it concerns an improvement to this type of ski, and especially in its assembly zone for the bindings.

2. Discussion of Background and Material Information

Different types of skis are already known, and they have a large number of variations. These skis are constituted of a beam of an elongated shape, whose front end is curved upwardly to constitute a spatula, the rear end also being slightly curved to constitute the heel.

Current skis generally have a composite structure in which different materials are combined such that each of them intervenes in an optimal manner, in view of the distribution of mechanical stresses during use of the ski. Thus, the structure generally comprises peripheral protection elements, internal resistance elements to resist flexion and torque stresses, and a core. These elements are assembled by adhesion or by injection, the assembly generally being hot formed in a mold that has the definitive shape of the ski, with a front portion that is substantially raised in a spatula, a rear portion slightly raised in a heel, and a central arched portion.

Despite manufacturer's concerns for constructing good quality skis, they have not, until now, obtained a high performance ski that is satisfactory under all circumstances.

As such, some efforts have already been made to resolve the shock absorption problem and the behavioral problems of the ski. More particularly, proposals have been made to intersperse shock absorption devices between the binding(s) of the boot on the ski.

These devices are adapted to improve the comfort of the skier, as well as the behavior and performance of the skis. Without shock absorbers, all the irregularities of the slopes, which are becoming increasingly harder because they are increasingly better damped, subject the ski to shocks and vibrations that are directly transmitted to the skier, whose skeleton, joints, muscles and tendons are placed under substantial stress. This results not only in a lack of comfort, but also in fatigue capable of resulting in accidents. Moreover, the excessively rigid connections between the skier and the ski is detrimental to satisfactory behavior of the ski, especially due to a much too substantial grip of the running edges in the snow that brings about sudden braking. But the devices proposed are only adaptations, and are not entirely satisfactory.

SUMMARY OF THE INVENTION

The present invention aims to overcome these disadvantages by proposing a ski whose shock absorption device is integrated in its structure.

To this end, the ski according to the invention has the shape of an elongated beam comprising a core, a lower reinforcement and an upper reinforcement, and comprises, in the assembly zone of the bindings, at least one shock absorption element, wherein the shock absorption element is arranged on the first upper reinforcement and beneath a second central upper reinforcement.

According to a complementary arrangement, the second upper reinforcement is covered by an upper superficial cover layer extending frontwardly and rearwardly to cover the first upper reinforcement beyond the assembly zone.

The first upper reinforcement and the second upper central reinforcement comprise layers of composite materials or metallic alloys, whereas the core is a synthetic foam, wood or a honeycomb shape, and the superficial cover layer is made of polyamide or of a thermoplastic material.

According to an additional characteristic, the shock absorption element comprises a strip of material that is elastically deformable, and for example, is made of viscoelastic material.

According to another arrangement, the shock absorption element comprises at least two independent elements, one of which has dimensional and/or mechanical and physical characteristics that are different from the other. For example, it comprises three independent elements.

According to an additional characteristic, the equipped ski is such that the retention screws of the bindings are anchored both in the first upper reinforcement and in the second upper central reinforcement.

The ski according to the invention allows at least three functions to be fulfilled: shock absorption of the structure, better tolerance of pressure distribution, and a substantial improvement of the suspension of the skier with respect to the shocks borne by the ski. Thus, the shock absorption elements are positioned at those places where the deformation is at a maximum, that is, at the front and at the rear of the assembly zone. The aim is to achieve a shock absorption gradient all along the assembly zone with maximum shock absorption at the ends and a minimum at the center. In order to dissipate the energy of the shock absorption element, this element is held in a sandwich between two rigid elements that thus bring about its shearing.

BRIEF DESCRIPTION OF THE DRAWINGS

Other characteristics and advantages of the invention will become more apparent from the description that follows, in light of the annexed drawings, that are given as non-limiting examples only.

DETAILED DESCRIPTION OF THE INVENTION

Figure 1:
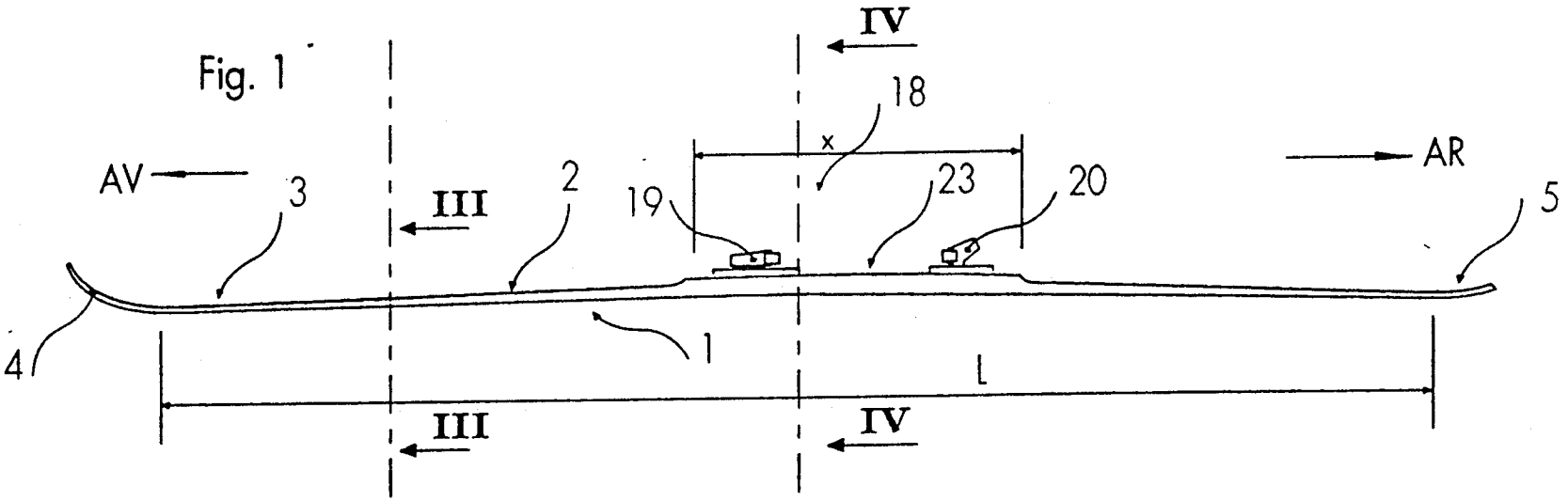
FIG. 1 is a side view of a first embodiment of a ski according to the invention.

FIG. 1 represents a ski according to a first embodiment according to the invention. The body of the ski, in a known manner, has the shape of an elongated beam having a lower sliding surface 1, and an upper surface 2. The slightly arched central portion extends frontwardly, on the one hand, by a frontal portion 3 raised to form the spatula 4, and on the other hand, by a rear portion 5 slightly raised to form the heel of the ski. The rear portion 5 has a relatively small length, and is relatively less raised and the frontal portion 3 is longer and much more arched, as is well known, and as represented in the drawing.

Figure 2:
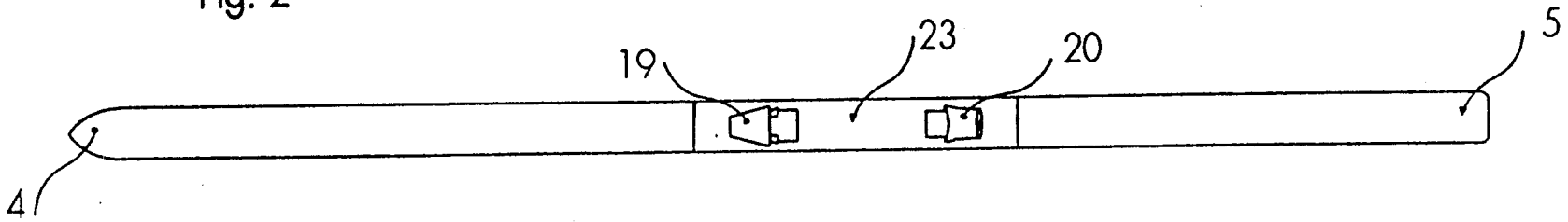
FIG. 2 is an elevational view of FIG. 1.
Figure 3:
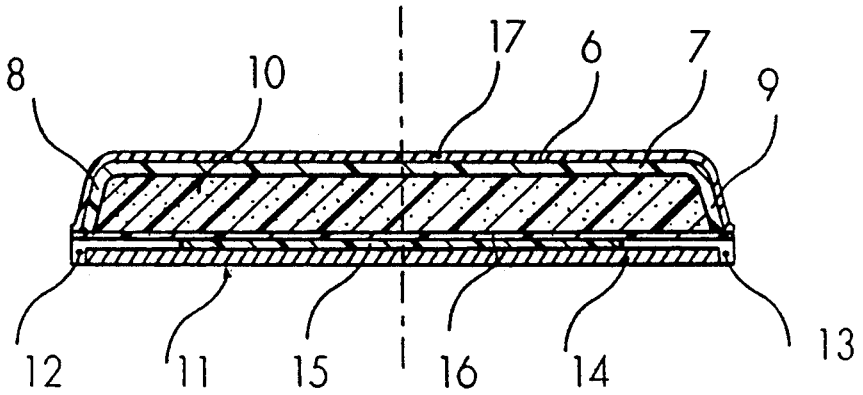
FIG. 3 is a transverse section along III—III of FIG. 1.
Figure 4:
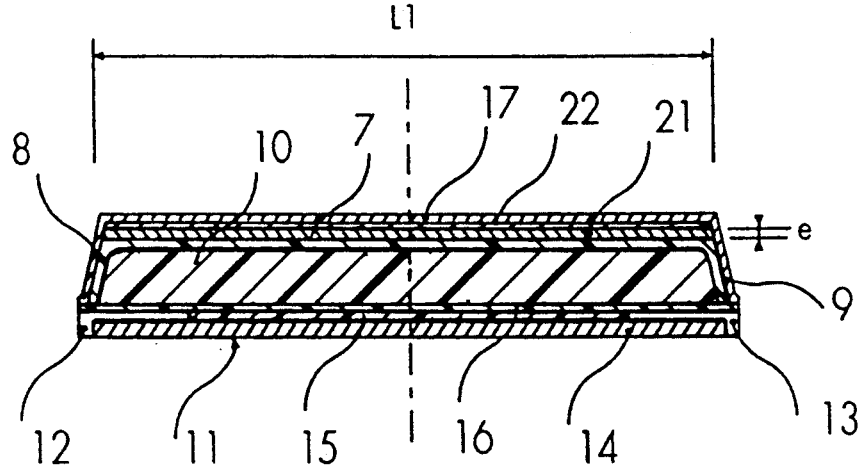
FIG. 4 is a transverse section along IV—IV of FIG. 1.

The structure of the body of the ski may be of the sandwich type or of the box type or of any other type. FIGS. 2, 3 and 4 represent a preferred structure comprising a first rigid upper reinforcement 6, in the shape of a shell with a "U"-shaped section forming an upper wall 7 and two side walls 8 and 9, having a core 10, the assembly being closed at its lower portion by a lower element 11 comprising metallic running edges 12, 13, a sliding layer 14 generally made of polyethylene as well as lower reinforcement elements 15, 16. An upper superficial layer 17 covers the upper reinforcement to form the decorative appearance of the ski.

Figure 12:
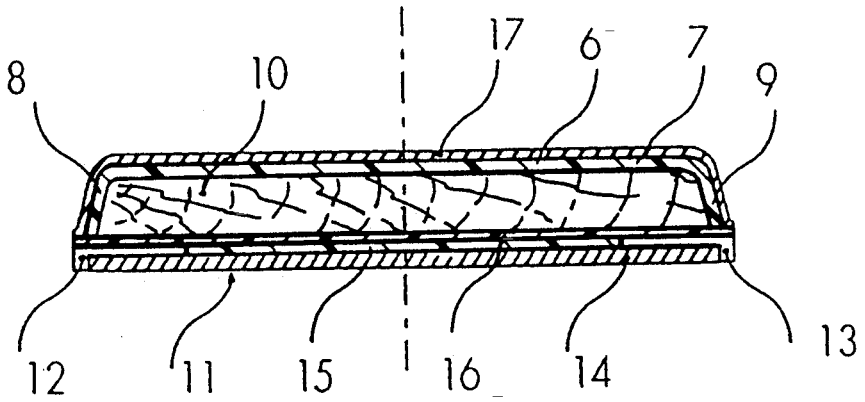
FIG. 12 is a view similar to FIG. 3, illustrating a ski structure including a wood core.
Figure 13:
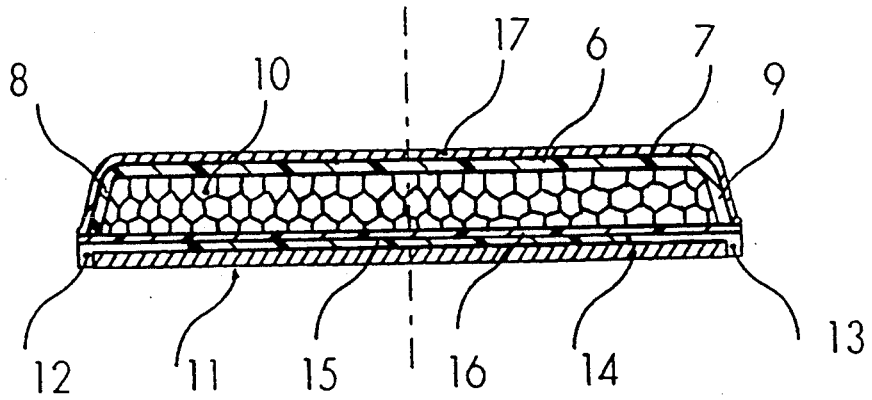
FIG. 13 is a view similar to FIG. 3, illustrating a ski structure including a honeycomb core.

The reinforcement layers 6, 15, 16 may be of any type, such as layers of composite materials like fiberglass, carbon fiber with epoxy resin or polyester, or of a metallic alloy. The core 10 may be of foam, reinforced or not, by wood or an aluminum honeycomb. FIGS. 12 and 13 schematically illustrate the aforementioned wood and aluminum honeycomb cores, respectively. The superficial layer ensuring the decor may be of polyamide, or any other material such as a thermoplastic material. It may be single layer or be constituted of several layers.

The ski comprises a shock absorption element 21 in its assembly zone 18 for bindings 19, 20. According to the invention, this shock absorption element 21 is arranged in the central portion of the ski, at the level of the assembly zone 18 of the bindings, on the one hand, on the upper reinforcement 6, and more precisely on the upper surface of its upper wall 7, and on the other hand, beneath a second upper central reinforcement 22. The shock absorption element is thus held in a sandwich between two rigid reinforcement layers 7, 22.

The shock absorption element 21 is constituted by a resilient strip of material, advantageously of the viscoelastic type. This strip, whose thickness is comprised between 0.5 to 6 mm, may thus be of a viscoelastic synthetic thermohardenable or thermoplastic rubber or reinforced PVC. This strip, localized in the central portion 18 at the level of the assembly zone of the bindings does not extend longitudinally along the entire width of the ski, but only partially, and has a length "X" that depends on the length "L" of the ski. Thus the length "X" of the shock absorption element may be, for example, comprised between 400 and 1000 millimeters. The material used to constitute the shock absorption element may be an elastic material with a shore hardness A comprised between 60 and 90, or a viscoelastic material having a shock absorption value of 0.1 to 0.8 (values at a temperature of 20° and a frequency of 15 Hz). The second upper reinforcement 22 is a layer of composite materials such as fiberglass or carbon with epoxy resin or polyester, or a metallic sheet such as, for example steel or aluminum. This layer may be a single layer or be constituted of several layers The second upper reinforcement arranged on the shock absorption element 21 is affixed to the latter by adhesion or welding and has, for example, a thickness comprised between 0.5 and 2 mm. The shock absorption element 21 is, moreover, adhered on the upper wall 7 of reinforcement 6. It has, in the example represented, a length "X" and a width "L1" respectively equal to the length "X" and width "L1" of the shock absorption element 21. In light of the fact that the shock absorption element 21 is arranged on the upper reinforcement layer 7 that extends along the entire length of the ski, this assembly zone 18 of the bindings may be projecting with respect to the general upper plane of the ski to constitute a platform 23 with the length "X" and a height "h".

Figure 5:
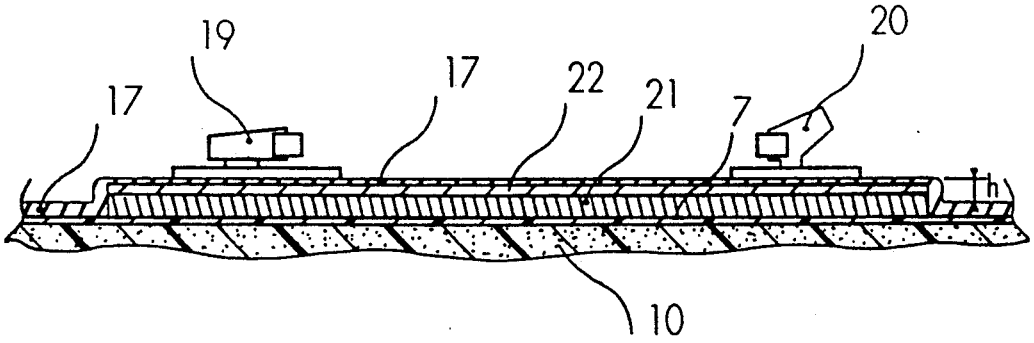
FIG. 5 is a partial view, at a larger scale, along a longitudinal section of the central portion of the ski and the assembly zone of the bindings.
Figure 5A:
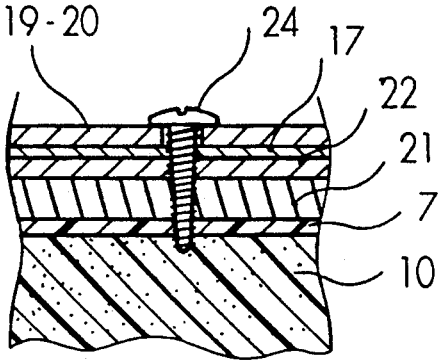
FIG. 5*a* represents a detail of the binding assembly zone, showing the anchoring of a screws for securing the bindings.

It can be noted that the superficial layer 17 covering the top of the second upper central reinforcement 22 extends frontwardly and rearwardly beyond the platform to cover the first upper reinforcement 6, 7. The screws 24 adapted to retain the bindings are anchored both in the first upper reinforcement 7 and in the second upper central reinforcement 22, covering the shock absorption element 21 as can be seen in FIG. 5*a*.

Figure 6:
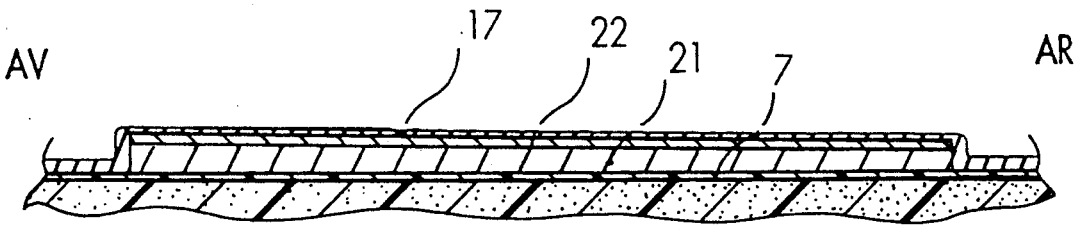
FIGS. 6–11 are views similar to FIG. 5 showing variations of the embodiment.
Figure 7:
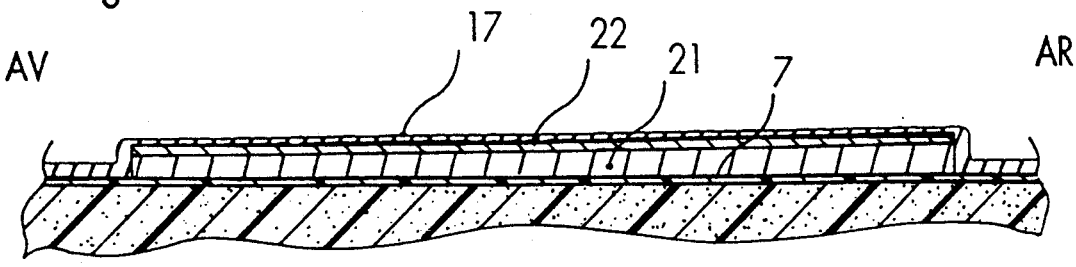

According to the first embodiment represented in FIGS. 1, 2, 3 and 4, the thickness "e" of the strip constituting the shock absorption element is constant, but it may also be otherwise, as is represented in FIGS. 6 and 7.

Thus, according to a variation of FIG. 6, thickness "e" of the shock absorption element 21 is greater at the front (AV) and diminishes progressively towards the rear (AR).

According to the variations of FIG. 7, the variation is inverted, and thickness "e" of the shock absorption element 21 is greater at the rear (AR) and diminishes progressively towards the front (AV).

Figure 8:
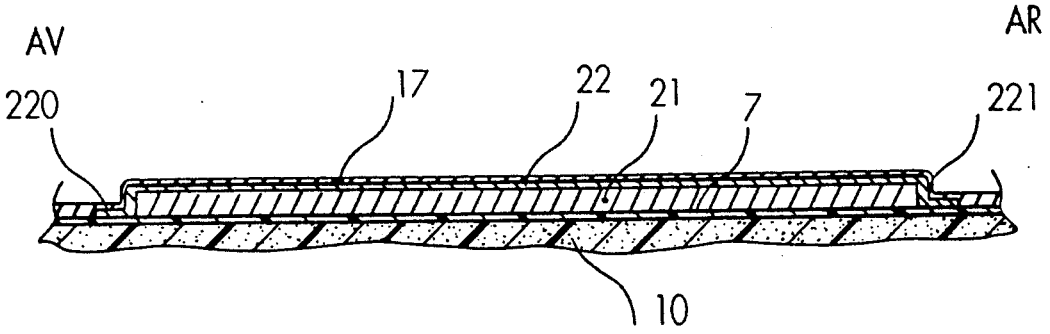

FIG. 8 is a variation according to which the second upper central reinforcement 22 extends frontwardly (AV) and rearwardly (AR) beyond the shock absorption element 21 to be affixed at the front and at the rear by its front 220 and rear 221 ends to the upper wall 7 of the first upper reinforcement 6.

Figure 9:
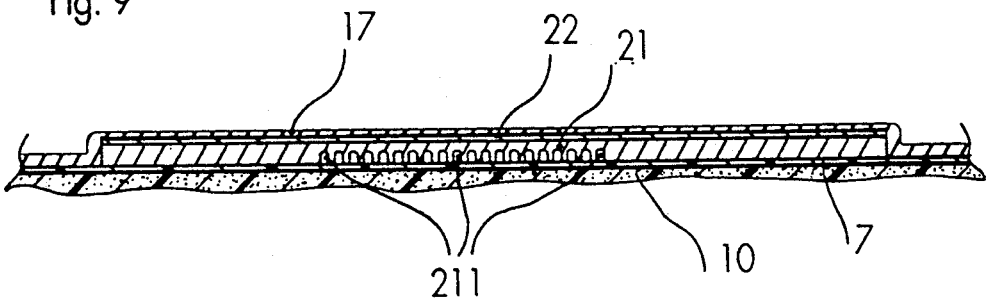

FIG. 9 is another variation according to which the lower part of the central portion of the shock absorption element 21 comprises a series of hollow transverse sections 211. The hollow sections are adapted to give better flexibility to the central portion of the shock absorption element.

Figure 10:
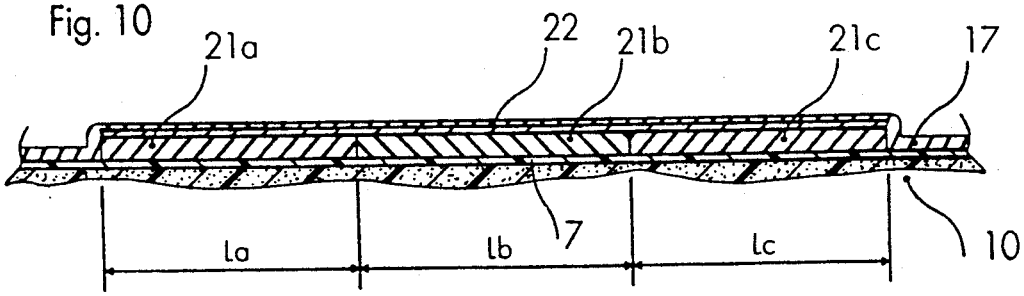
Figure 11:
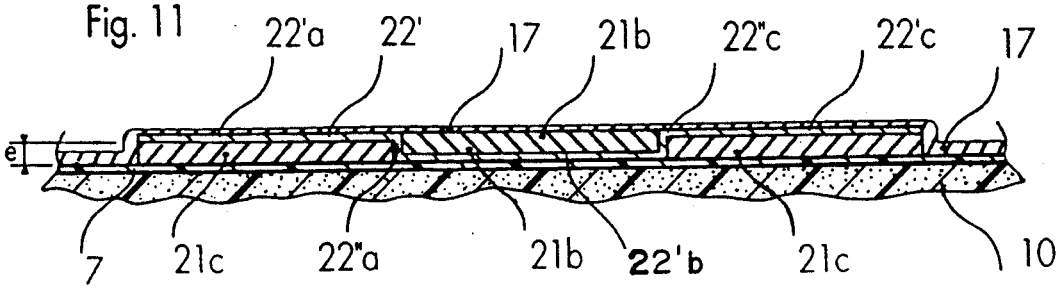

According to a complementary characteristic, the shock absorption element 21 made up of a single element in the embodiments described previously, may also be made up of two or three distinct elements (FIGS. 10 and 11). Indeed, the shock absorption element may be constituted of three independent elements 21*a*, 21*b*, 21*c*, of which at least one is made of a material different from the two others. Thus, the front element 21*a* may be arranged beneath the front binding 19 whereas the rear element 21*b* is arranged beneath the rear binding 20, the median element 21*b*, being arranged between said front element 21*a* and said rear element 21*c*.

The respective lengths "La", "Lb", "Lc" of the different elements 21*a*, 21*b*, 21*c* may, for example be such that:

"La" and "Lc" are comprised between 150 and 190 mm.; and

"Lb" is comprised between 180 and 250 mm.; or:

"La" and "Lc" are comprised between 200 and 400 mm.; and

"Lb" is comprised between 150 and 200 mm.

As described previously, at least one of the elements is constituted of a material that is different from the two others or, has dimensional or physical characteristics that are different from the two others.

Thus, the front element 21*a* may have mechanical and physical characteristics that are equal or substantially equal to the rear element 21*c*, whereas the median element is different from them. For example, the front element 21 and rear element 21*c* may be of a viscoelastic material with a shore hardness A of 70 to 80 and a shock absorption value of 0.1 to 0.4, whereas the median element is made of an elastic material with a shore hardness A of 30 to 70.

One may also have an arrangement in which the front 21*a* and the rear 21*c* elements are made of a viscoelastic material with a shore hardness A of 80 to 90 and a shock absorption value of 0.3 to 0.8, whereas the medium element is made of an elastic material with a shore hardness A 30 to 70.

It is also possible to have an arrangement in which the three elements 21*a*, 21*b*, 21*c* have different characteristics.

FIG. 11 represents another variation according to which the second upper central reinforcement 22' has, in a longitudinal section, the form of an inverted Ω constituted by a front horizontal wall 22'a extended by a front transverse wall 22''a extending downwardly, and then a horizontal central wall 22'b extending upwardly by a rear transverse wall 22''c extending rearwardly by a rear horizontal wall 22'c. The two front horizontal wall 22'a and rear wall 22'c are spaced by a height "e" of the first upper reinforcement 6, 7 to constitute a housing respectively for the front shock absorption element 21*a* and the rear shock absorption element 21*c*. On the other hand, the central horizontal wall 22'b is directly affixed to the upper wall 7 of the upper reinforcement 6. The three shock absorption elements 21*a*, 21*b*, 21*c* may be, as in the preceding case, identical or different dimensionally and/or have different mechanical or physical characteristics.

As can be seen in the drawings, the second upper central reinforcement 22 has a length smaller than the length of the first upper reinforcement 6 and especially of its horizontal wall 7.

The instant application is based upon French patent application 91.01703 of Feb. 8, 1991, the disclosure of which is hereby expressly incorporated by reference thereto, and the priority of which is hereby claimed.

It is to be understood that the invention is not limited to the embodiments described herewith and represented as examples only, and it also comprises all technical equivalents as well as their combinations, other variations also being possible without leaving the scope of the invention.

What is claimed:

1. A ski comprising:

a core;

an upper reinforcement positioned above the core;

a lower reinforcement positioned below the core;

a binding assembly zone located in an intermediate longitudinal zone of the ski;

an upper central reinforcement located in the binding assembly zone of the ski and extending continuously in the binding assembly zone of the ski;

at least one shock absorption element located in the binding assembly zone of the ski and positioned above the upper reinforcement and beneath the upper central reinforcement;

an upper superficial layer extending continuously within the binding assembly zone and covering the upper reinforcement beyond the binding assembly zone; and screws for anchoring bindings onto the ski, wherein the screws are secured through both the upper reinforcement and the upper central reinforcement.

2. The ski of claim 1, wherein:

the upper superficial layer comprises a member selected from the group consisting of polyamide and a thermoplastic material.

3. The ski of claim 1, wherein:

the upper reinforcement and the upper central reinforcement are constituted by layers of composite materials.

4. The ski of claim 1, wherein:

the upper reinforcement and the upper central reinforcement are constituted by layers of metallic alloys.

5. The ski of claim 1, wherein:

the core comprises a synthetic foam.

6. The ski of claim 1, wherein:

the core comprises wood.

7. The ski of claim 1, wherein:

the core comprises a honeycomb structure.

8. The ski of claim 1, wherein:

the at least one shock absorption element comprises a strip of elastically deformable material having a predetermined thickness and a predetermined length.

9. The ski of claim 8, wherein:

the at leas one shock absorption element comprises a viscoelastic material.

10. The ski of claim 9, wherein:

said predetermined thickness is between 0.5 and 6 millimeters.

11. The ski of claim 10, wherein:

said predetermined length is between 400 and 1000 millimeters.

12. The ski of claim 1, wherein:

the at least one shock absorption element comprises at least two distinct elements which are dimensionally different.

13. The ski of claim 1, wherein:

the at least one shock absorption element comprises at least two distinct elements which have different mechanical and physical characteristics.

14. The ski of claim 1, wherein:

the at least one shock absorption element comprises at least three distinct elements, each of the three distinct elements being dimensionally different.

15. The ski of claim 14, wherein:

the three distinct elements extend longitudinally adjacent each other to constitute a front element, a rear element and a median element; and the front element and the rear element comprise a viscoelastic material.

16. The ski of claim 15, wherein:

each of the front element and the rear element has a length between 150 and 400 millimeters.

17. The ski of claim 16, wherein:

each of the front element and the rear element has a shore A hardness value of 70–90 and a shock absorption value of 0.1–0.8; and the median element comprises an elastic material having a shore A hardness value of 35–70.

18. The ski of claim 1, wherein:

the at least one shock absorption element comprises at least three distinct elements, each of the three distinct elements having different mechanical and physical characteristics.

19. The ski of claim 18, wherein:

the three distinct elements extend longitudinally adjacent each other to constitute a front element, a rear element and a median element; and the front element and the rear element comprise a viscoelastic material.

20. The ski of claim 19, wherein:

each of the front element and the rear element has a length between 150 and 400 millimeters.

21. The ski of claim 20, wherein:

each of the front element and the rear element has a shore A hardness value of 70–90 and a shock absorption value of 0.1–0.8; and the median element comprises an elastic material having a shore A hardness value of 35–70.

22. The ski of claim 1, wherein:

the upper central reinforcement has a first length and the upper reinforcement has a second length, wherein the first length of the upper central reinforcement is less than the second length of the upper reinforcement.

23. The ski of claim 22, wherein:

the shock absorption element is secured directly to the upper reinforcement and secured to the upper central reinforcement.

24. The ski of claim 22, wherein:

the shock absorption element is welded to the upper reinforcement and secured to the upper central reinforcement.

25. The ski of claim 1, further comprising:

a front upper ski surface forward of the binding assembly zone and a rear upper ski surface rearward of the binding assembly zone, wherein the shock absorption element, in the binding assembly zone, has a thickness that defines a platform that projects upwardly with respect to front upper ski surface and the rear upper ski surface.

26. The ski of claim 1, wherein:

the upper central reinforcement is located only in the binding assembly zone of the ski; and the at least one shock absorption element is located only in the binding assembly zone of the ski.

27. The ski of claim 26, further comprising:

a front upper ski surface forward of the binding assembly zone and a rear upper ski surface rearward of the binding assembly zone, wherein the shock absorption element, in the binding assembly zone, has a thickness that defines a platform having a size for receiving a binding thereon, the platform projecting upwardly with respect to front upper ski surface and the rear upper ski surface.

* * * * *